US005170146A

United States Patent [19]

Gardner et al.

[11] Patent Number: 5,170,146

[45] Date of Patent: Dec. 8, 1992

[54] LEADLESS RESISTOR

[75] Inventors: Kelly A. Gardner, Oakland Park; Tuan K. Nguyen, Boca Raton; Silvia M. Viteri, Lantana, all of Fla.

[73] Assignee: Motorola, Inc., Schaumburg, Ill.

[21] Appl. No.: 739,073

[22] Filed: Aug. 1, 1991

[51] Int. Cl.[5] ..... H01C 1/012

[52] U.S. Cl. ..... 338/313; 338/272; 338/332

[58] Field of Search ..... 338/313, 332, 307, 308, 338/309, 314, 227, 272; 361/540

[56] References Cited

U.S. PATENT DOCUMENTS

| | | | |
|---|---|---|---|
| 3,611,275 | 10/1971 | Leddy et al. | 338/332 X |
| 4,698,614 | 10/1987 | Welch et al. | 338/332 X |
| 4,774,491 | 9/1988 | Vugts | 338/306 |
| 4,884,053 | 11/1989 | Bougger | 338/332 X |
| 5,111,179 | 5/1992 | Flassayer et al. | 338/313 |

OTHER PUBLICATIONS

Brochure–State of the Art, Inc., No. TN1088.

*Primary Examiner*—Marvin M. Lateef

*Attorney, Agent, or Firm*—Dale W. Dorinski; Daniel K. Nichols

[57] ABSTRACT

A leadless electrical resistor (40), comprising a parallelepiped dielectric body (42), or chip, having a resistive film element (44) on one face. A pair of conductive terminations (46) are connected to opposite ends of the resistive element in order to form a chip resistor. A second resistive film element (54) is formed on the opposing face of the dielectric body in a direction perpendicular to the first resistor. A second pair of conductive terminations (56) are connected to opposite ends of the second resistive element (54) in order to form a second resistor on the back side of the chip. The terminations of the second resistor are on adjacent sides of the chip body compared to the terminations of the first resistor, thus forming a chip resistor (40) having two resistive elements (44 and 54) with terminations (46 and 56) on the four vertical walls of the chip.

18 Claims, 4 Drawing Sheets

LEADLESS RESISTOR

TECHNICAL FIELD

This invention relates generally to an electrical resistor, and more particularly to leadless chip resistors having two resistive elements.

BACKGROUND

Leadless chip resistors are widely used in surface-mount technology electronic assemblies. Historically, the major users of chip resisters have been hybrid circuit manufacturers. Chip resistors have been used in place of thick film printed resistors for reasons such as ability to obtain extreme resistance values, unusual values, close tolerances, and to achieve lower overall cost. More recently, as the techniques of leadless component mounting have improved, the advantages of chip resistors have increased over printed resistors. These advantages are now recognized by conventional circuit assemblers on printed circuit boards.

Referring to FIG. 1, a leadless chip resistor 10 is formed on a ceramic body 12, having the shape of a rectangular prism or parallelepiped. On one face of the ceramic body, a thick film resistive element 14 is printed. Many types of different resistant inks are used in order to fabricate resistors with varying resistance values and varying tolerances. Two opposing ends of the resistive element are connected to an electrically-conductive terminations 16. The terminations employ numerous configurations such as wraparound or flip chip. In the wraparound style, the termination overlaps the resistive element and wraps around a second face of the ceramic and portions of the underside of the ceramic. Other styles of termination, such as flip chip terminations, simply have a pad of conductive material connected to the resistive element on the face of the ceramic body. Materials used for terminations are typically solder, gold, tin, lead, indium, silver, platinum, nickel, and combinations thereof. Most chip resistors used in wave soldering have a precious metal base coating covered by a plated nickel barrier layer and a top coating of tin/lead solder. The nickel barrier serves to prevent leaching of the precious metal base coat, thereby assuring a reliable electrical connection to the circuit board.

A protective glass passivation coating over the resistive element is sometimes used. This passivation eliminates the possibility of foreign materials, such as conductive epoxy, contaminating the resistive element and changing its value. Passivation also prevents solder from leaching the resistor body during soldering, which can cause minor resistance changes. The completed resistor is typically trimmed by laser or airabrasive techniques in order to achieve the desired resistance.

Prior art resistors (FIG. 1 and FIG. 3) all use a single element (14 and 34) on one side of the ceramic body. Resistive networks (FIG. 2) are made from a silicon body 22 and have numerous resistors 34 printed on one surface of the silicon and interconnected in various configurations. The silicon chip has many terminations 36 allowing the end user to custom select the resistance value using only a single component.

Although resistive networks have overcome some of the disadvantages of discrete chip resistors, namely the ability to have different resistive values in a single package, this result is achieved at the expense of a much larger package. Discrete, leadless chip resistors continue to suffer the disadvantage of requiring a unique package and part number for every resistive value and tolerance. This requires that many different types of chip resistors are used in assembling a single electronic assembly. Clearly, it would be advantageous to reduce the number of unique parts required. A resistive package employing more than one resistive value in a package and having a small size approaching that of a discrete chip resistor would be highly advantageous and eagerly sought by the surface mount technological industry.

SUMMARY OF THE INVENTION

Briefly, according to the invention, there is provided a leadless electrical resistor, comprising a parallelepiped dielectric body, or chip, having first and second opposed faces, first and second opposed ends, and first and second opposed sides. A resistive film element is formed on a first face. A pair of conductive terminations are on the first and second opposed ends of the dielectric body and are also connected to opposite ends of the resistive element in order to form a chip resistor. A second resistive film element is formed on the opposing face of the dielectric body in a direction perpendicular to the first resistive element. A second pair of conductive terminations are on the first and second opposed sides of the dielectric body and are connected to opposite ends of the second resistive element in order to form a second resistor on the back side of the chip. The terminations of the second resistor are on adjacent sides of the chip body compared to the terminations of the first resistor, thus forming a chip resistor having two resistive elements with terminations on the four vertical walls of the chip.

In a further embodiment, the resistive elements have the conductive terminations on adjacent sides of the element.

In another embodiment, the resistive elements are formed using thin film technology.

In still another embodiment, one or both of the resistive elements are zero resistance elements, forming a jumper.

DETAILED DESCRIPTION OF THE PREFERRED EMBODIMENT

Figure 1:
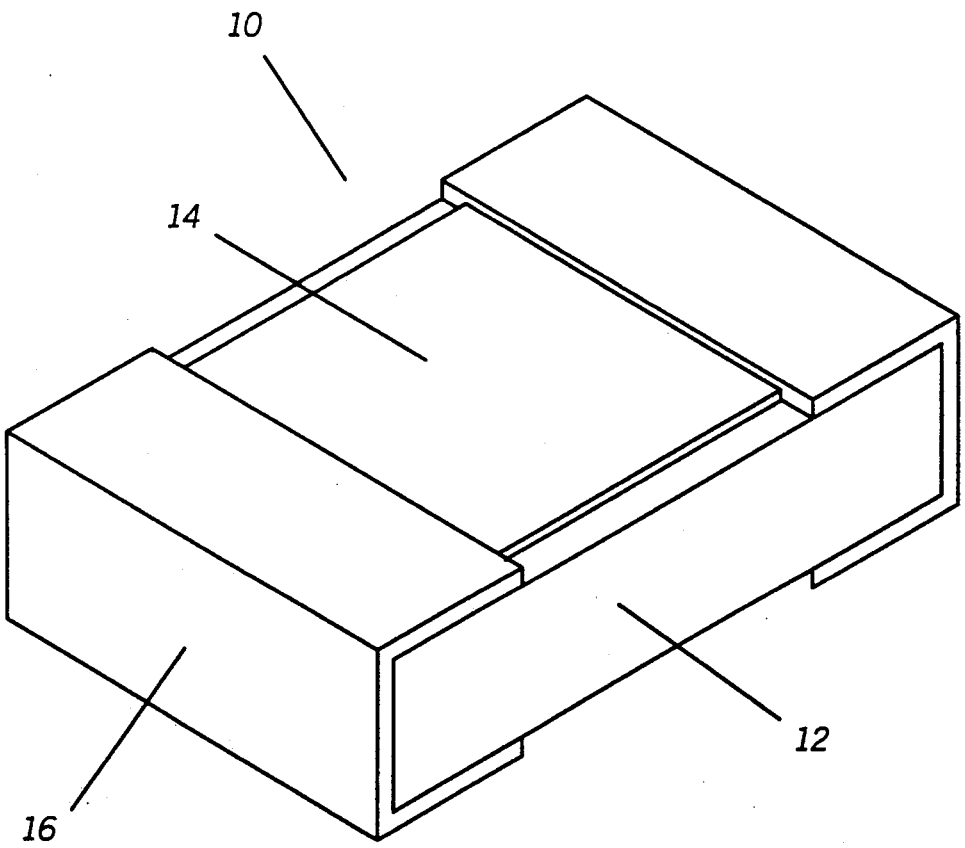
FIG.1 (PRIOR ART)
FIG. 1 is an isometric view of a leadless chip resistor in accordance with the prior art.
Figure 2:
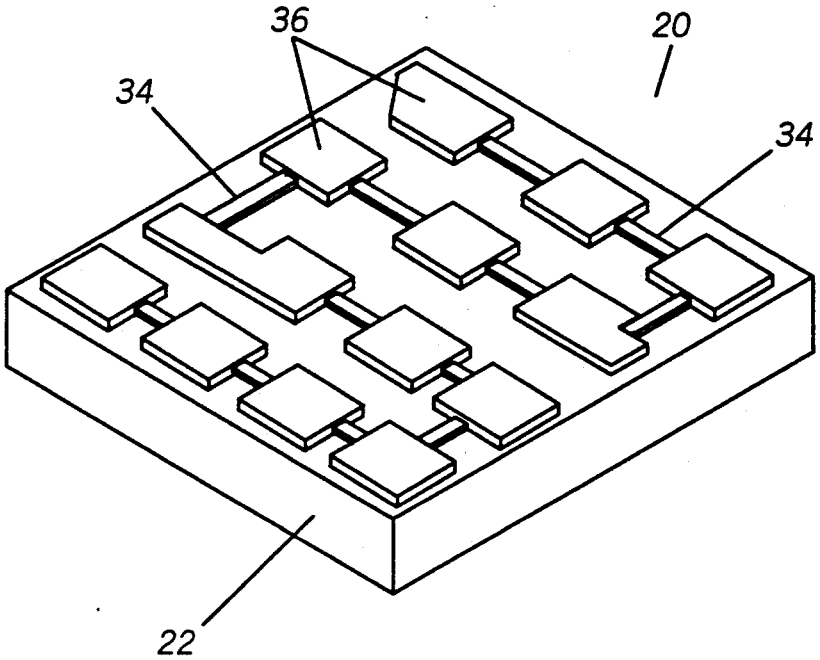
FIG.2 (PRIOR ART)
FIG. 2 is an isometric view of leadless chip resistor network having multiple resistive elements in accordance with the prior art.
Figure 3:
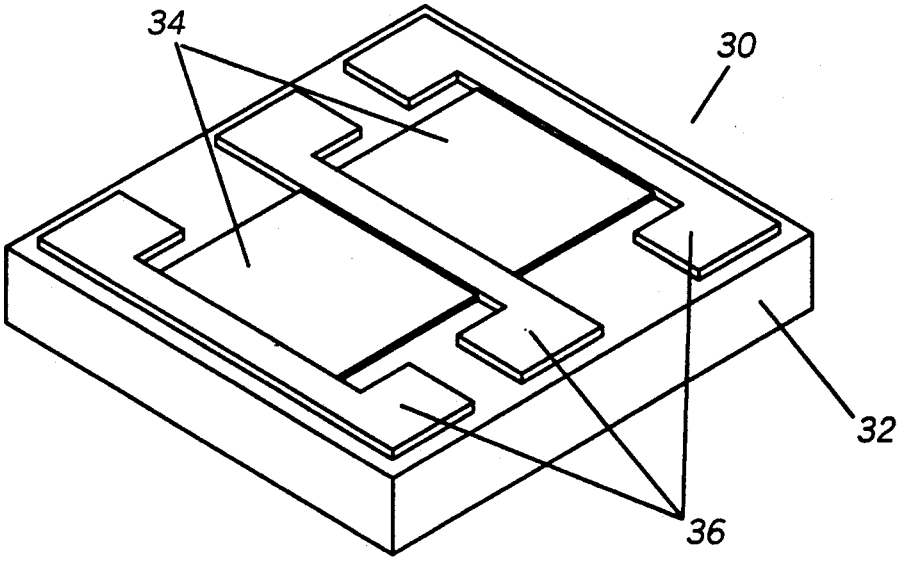
FIG.3 (PRIOR ART)
FIG. 3 is an isometric view of a leadless chip resistor having a center tap in accordance with the prior art.
Figure 4:
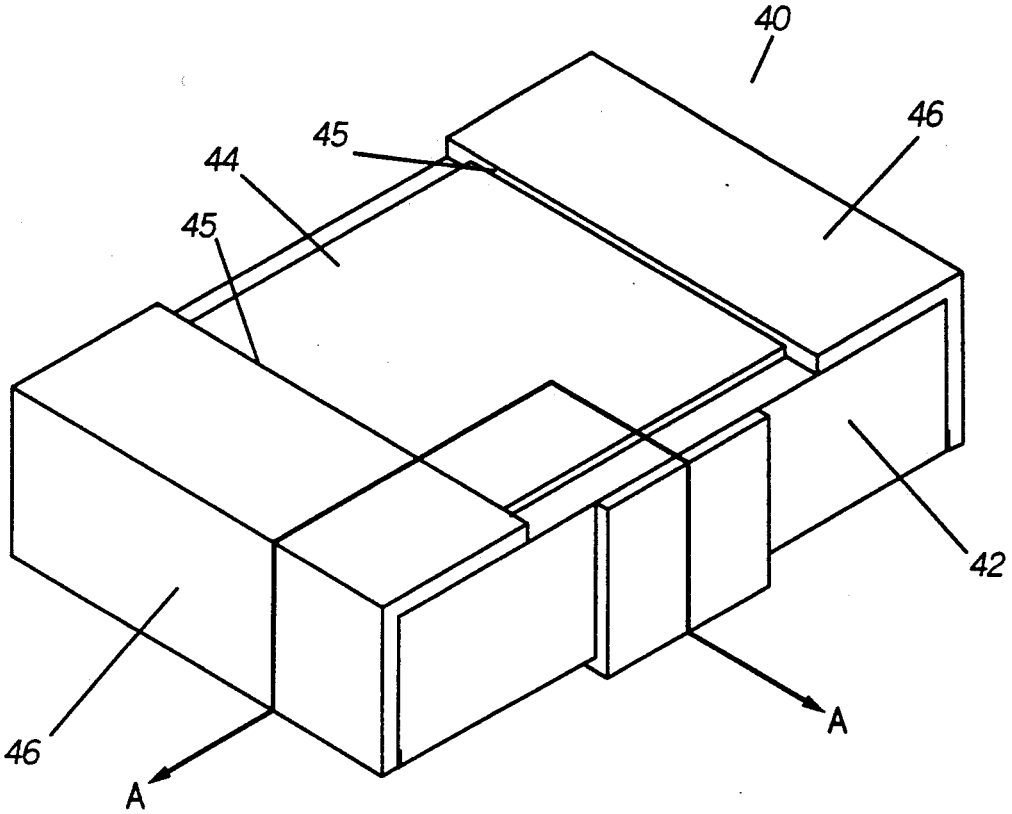
FIG. 4 is an isometric view of the top side of a leadless chip resistor in accordance with the invention.

Referring now to FIG. 4, a leadless chip resistor 40 is comprised of an alumina ceramic body 42 in the form of a rectangular prism or parallelepiped. A parallelepiped is a polyhedron having six sides or faces, each side being formed in the shape of a parallelogram. Thus, there are three pairs of opposing sides or faces. A thick film resistive element 44 is formed on the top face of the ceramic body 42. At opposing ends 45 of the resistive element 44, conductive electrical terminations 46 are formed. The conductive terminations are attached to the resistive element 44 in order to form electrical attachment points to the element. The conductive terminations 46 are typically formed of metals such as solder, gold, platinum, silver, nickel, tin, indium, lead, and combinations or alloys of each of these materials. Depending on the intended application of the chip resistor 40, the conductive terminations may be gold (when wire bonding attachment to the substrate is to be used), or platinum/silver (when conductive epoxy attachment is to be used), or solder with a nickel barrier plating underneath the solder if wave soldering methods are to be used. Various types of solder such as tin/lead, tin/lead/silver, tin/lead/indium, etc., are commonly used in the industry. The terminations 46 extend from the edges 45 of the resistive element 42 to the edge of the ceramic body 42 and extend around the end face of the ceramic body 42 in order to form a wraparound termination.

Figure 5:
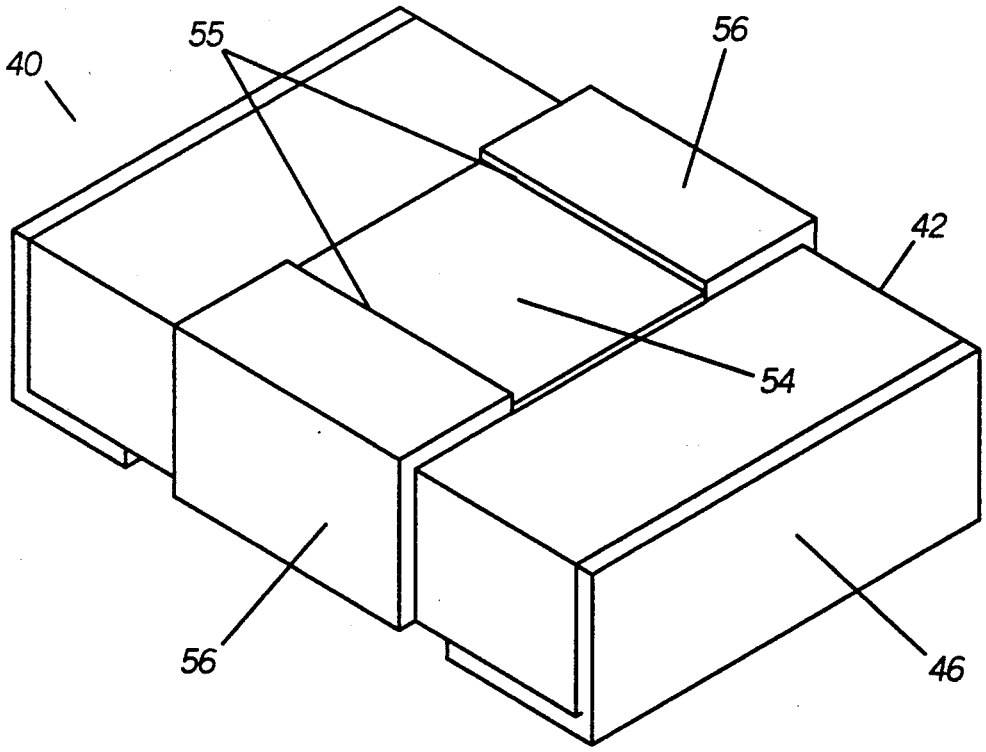
FIG. 5 is an isometric view of the bottom side of a leadless chip resistor in accordance with the invention.

On the obverse side of the ceramic body 42, a second resistive element 54 is formed as shown in FIG. 5. The resistive elements (44 and 54) are normally formed using thick film materials, but other methods, such as fabricating the resistive element from thin film materials, are equally applicable. This second resistive element is formed orthogonal or perpendicular to the direction of the first resistive element 44 on the top of the ceramic body. In a fashion similar to the first resistive element 44, the second resistive element 54 has conductive electrical terminations 56 at opposing ends of the resistive element. These terminations are on a second pair of opposing faces of the ceramic body 42, that is to say, adjacent to the pair of faces where the wraparound termination 46 of the first resistive element is located. This configuration provides two resistive elements (44 and 54) on a single ceramic body, the first element being on the top, the second element being on the bottom. Electrical terminations (46 and 56) for each resistive element are on adjacent faces of the ceramic body such that each vertical wall or face of the ceramic body 42 has an electrical termination. The chip resistor 40 is configured so that there is a reasonable dielectric space 57 between the electrical terminations 46 of the first resistive element and the electrical terminations 56 of the second resistive element. This serves to ensure that when the chip resistor is soldered to the hybrid circuit or printed circuit board, the electrical connections of the respective resistors will not short.

Figure 6:
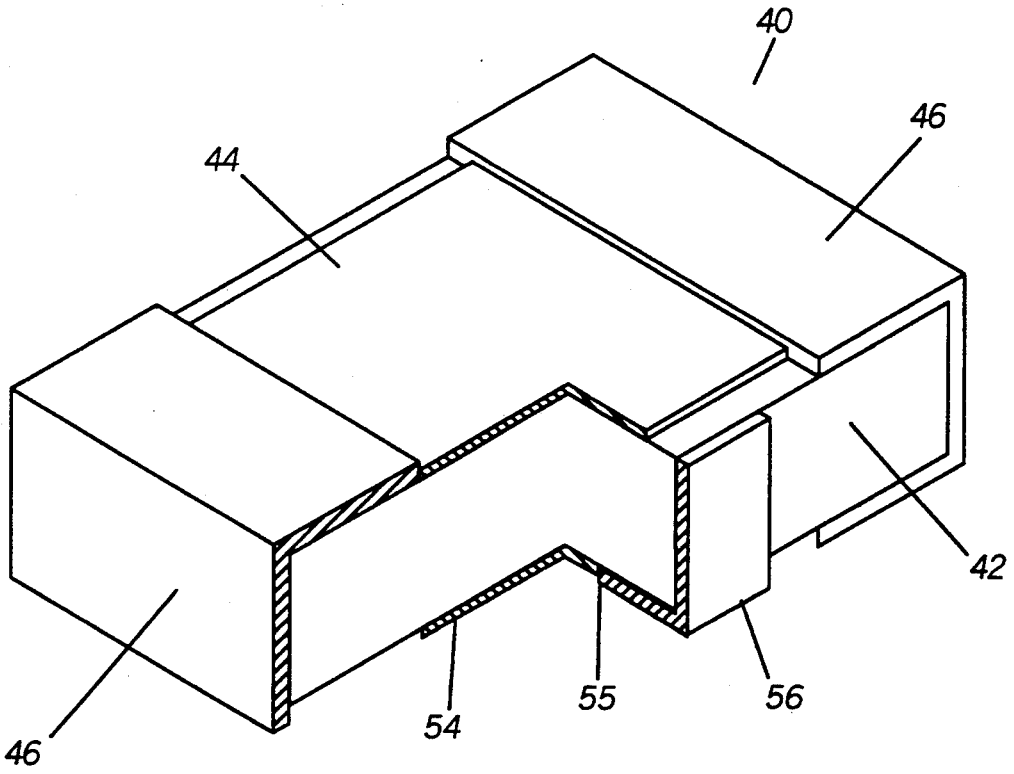
FIG. 6 is a cut-away view through section A—A of FIG. 4.

The reader is further directed to FIG. 6, showing a cut-away view of FIG. 4 in order to provide further clarification.

It can easily be seen that the same resistance value may be used for both resistive elements or different resistive values may be used. By using different resistive values, one can produce a chip resistor having two different resistive values in a single part. The flexibility of using such a chip resistor can easily be seen from the following. Depending upon the desired resistance value to be placed in the circuit, the chip resistor can be mounted either face up or face down, allowing one to custom select the required resistive value at the time of assembly. Further adding to the flexibility of the invention, the circuit designer may design the circuit in order to utilize both resistive elements. That is, solder all four electrical connections to the substrate in order to provide electrical connections to two resistors. This also allows one to achieve a multilayer structure on a printed circuit board without having to incur the added expense of fabricating multilayer substrates. If one of the resistive elements has zero or minimal resistance, for example, less than one (1) Ohm, the chip resistor may also function as jumper. This would allow a circuit designer to include both a resistor and a jumper to produce a multilayer structure at selected sites on the printed circuit.

An alternate embodiment of the invention employs the conductive terminations attached to adjacent sides of the resistive element. The configuration of the package is similar to that discussed in FIGS. 4, 5 and 6 except that the conductive terminations are formed on adjacent faces of the ceramic body rather than opposing faces of the ceramic body. This provides more flexibility in the design of the circuit package. Again, all the advantages inherent in the previous structure are inherent in the alternate embodiment.

In summary, it can be seen that a leadless chip resistor with two resistive elements on opposite faces of the ceramic body can be easily formed and provides a great deal of flexibility to the circuit designer. The use of such a chip resistor reduces the number of unique component parts required to assembly a circuit and also provides an advantage in achieving an additional layer or cross-over point without the need to utilize expensive multilayer substrates. The configurations and descriptions of the chip resistors shown in FIGS. 4 through 6 are intended to convey the concept of the present invention and similar and other chip resistor designs employing resistive elements on opposite faces may certainly be envisioned by one skilled in the art, to fall within the scope of the invention, for example, various types of terminations and combinations of terminations, such as wraparound, surface mount, nonwraparound, partial wraparound, etc. Accordingly, it is not intended that the present invention be limited except as by the appended claims herein.

What is claimed is:

1. A leadless electrical resistor, comprising:

a dielectric body comprising;

a polyhedron having first and second opposed faces, first and second opposed ends, and first and second opposed sides;

a first resistive film element, on the first face of the dielectric body;

a pair of first conductive terminations on the first and second opposed ends of the dielectric body and coupled to opposite ends of the first resistive element;

a second resistive film element formed on the second face of the dielectric body and in a direction perpendicular to the first element; and a pair of second conductive terminations on the first and second opposed sides of the dielectric body and coupled to opposite ends of the second resistive element.

2. The leadless electrical resistor as described in claim 1, wherein the dielectric body is alumina ceramic.

3. The leadless electrical resistor as described in claim 1, wherein the dielectric body is silicon.

4. The leadless electrical resistor as described in claim 1, wherein the resistive elements are thick film materials.

5. The leadless electrical resistor as described in claim 1, wherein the resistive elements are thin film materials.

6. The leadless electrical resistor as described in claim 1, wherein the first and second conductive terminations are selected from the group consisting of solder, gold, platinum, silver, nickel, tin, indium, lead, and combinations thereof.

7. The leadless electrical resistor as described in claim 1, wherein the first conductive terminations wrap-around the dielectric body.

8. The leadless electrical resistor as described in claim 1, wherein the second conductive terminations wrap-around the dielectric body.

9. The leadless electrical resistor as described in claim 1, wherein the first resistive element is a jumper having a resistance less than one ohm.

10. A leadless electrical resistor, comprising:

a dielectric body comprising;

a polyhedron having first and second opposed faces, first and second opposed ends, and first and second opposed sides;

a first resistive film element, on the first face of the dielectric body;

a pair of first conductive terminations on the first end and the first side of the dielectric body, and coupled to adjacent sides of the first resistive element;

a second resistive film element formed on the second face of the dielectric body; and a pair of second conductive terminations on the second end and the second side of the dielectric body, and coupled to adjacent sides of the second resistive element.

11. The leadless electrical resistor as described in claim 10, wherein the dielectric body is alumina ceramic.

12. The leadless electrical resistor as described in claim 10, wherein the resistive elements are thick film materials.

13. The leadless electrical resistor as described in claim 10, wherein the resistive elements are thin film materials.

14. The leadless electrical resistor as described in claim 10, wherein the first resistive element is a jumper having a resistance less than one ohm.

15. The leadless electrical resistor as described in claim 10, wherein the first and second conductive terminations are selected from the group consisting of solder, gold, platinum, silver, nickel, tin, indium, lead, and combinations thereof.

16. The leadless electrical resistor as described in claim 10, wherein the first conductive terminations wrap around the dielectric body.

17. The leadless electrical resistor as described in claim 10, wherein the second conductive terminations wrap around the dielectric body.

18. A chip resistor, comprising:

a parallelepiped alumina ceramic body comprising;

a polyhedron having first and second opposed faces, first and second opposed ends, and first and second opposed sides;

a first thick film resistive element, on the first face of the body;

a pair of first conductive terminations on the first and second opposed ends of the dielectric body and coupled to opposite ends of the first resistive element, said conductive terminations being selected from the group consisting of solder, gold, platinum, silver, nickel, tin, indium, lead, and combinations thereof;

a second thick film resistive element formed on the second face of the body and in a direction perpendicular to the first element; and a pair of second conductive terminations on the first and second opposed sides of the dielectric body and coupled to opposite ends of the second resistive element, said conductive terminations being selected from the group consisting of solder, gold, platinum, silver, nickel, tin, indium, lead, and combinations thereof.

* * * * *